United States Patent [19]

Parkinson

[11] 4,303,811

[45] Dec. 1, 1981

[54] KIT FOR USE IN THE CONSTRUCTION OF CUSTOM PROTOTYPE MEMBRANE SWITCH PANELS

[75] Inventor: Wayne K. Parkinson, Mequon, Wis.

[73] Assignee: W. H. Brady Co., Milwaukee, Wis.

[21] Appl. No.: 99,628

[22] Filed: Dec. 3, 1979

[51] Int. Cl.[3] ..... H01H 9/00; H01H 13/70

[52] U.S. Cl. ..... 200/5 A; 200/292; 200/308; 206/223

[58] Field of Search ..... 200/5 A, 159 B, 312, 200/317, 314, 11 TW, 292

[56] References Cited

U.S. PATENT DOCUMENTS

| | | | |
|---|---|---|---|
| 3,777,222 | 12/1973 | Harris | 200/317 X |
| 3,862,381 | 1/1975 | Glaister et al. | 200/5 A |
| 4,035,593 | 7/1977 | Riniker | 200/5 A |
| 4,060,703 | 11/1977 | Everett, Jr. | 200/317 X |
| 4,127,740 | 11/1978 | La Marche | 200/5 A X |
| 4,158,115 | 6/1979 | Parkinson et al. | 200/5 A |
| 4,190,749 | 2/1980 | Erickson et al. | 200/11 TW |
| 4,194,099 | 3/1980 | Mickelson | 200/5 A |
| 4,217,473 | 8/1980 | Parkinson | 200/5 A X |
| 4,218,600 | 8/1980 | Kissner | 200/5 A X |

OTHER PUBLICATIONS

Plessey Print Switch Catalog, Publication No. 4283, Feb. 1969, (pages included, cover, back page, p. 11, plastic overlay to p. 12, p. 12 and inside back page).

*Primary Examiner*—James R. Scott

[57] ABSTRACT

A kit for making custom prototype membrane switch panels which includes a plurality of switch units and an overlay unit for integration and protection of said switch panels and indicia carried thereby.

5 Claims, 10 Drawing Figures

FIG 3
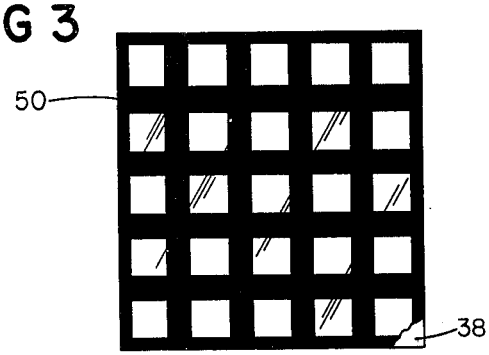
FIG 4A
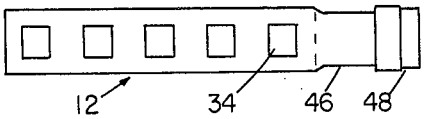
FIG 4B
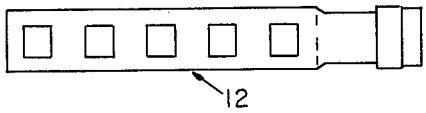
FIG 4C
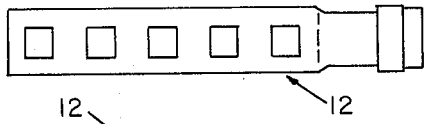
FIG 4D
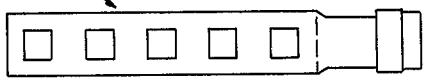
FIG 4E
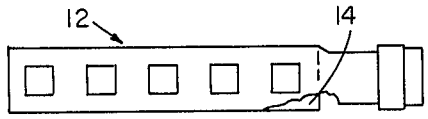
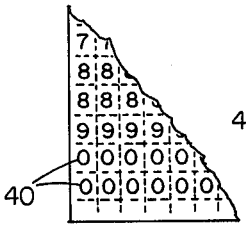
FIG 5A
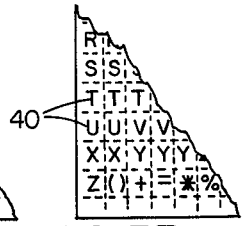
FIG 5B
FIG 2
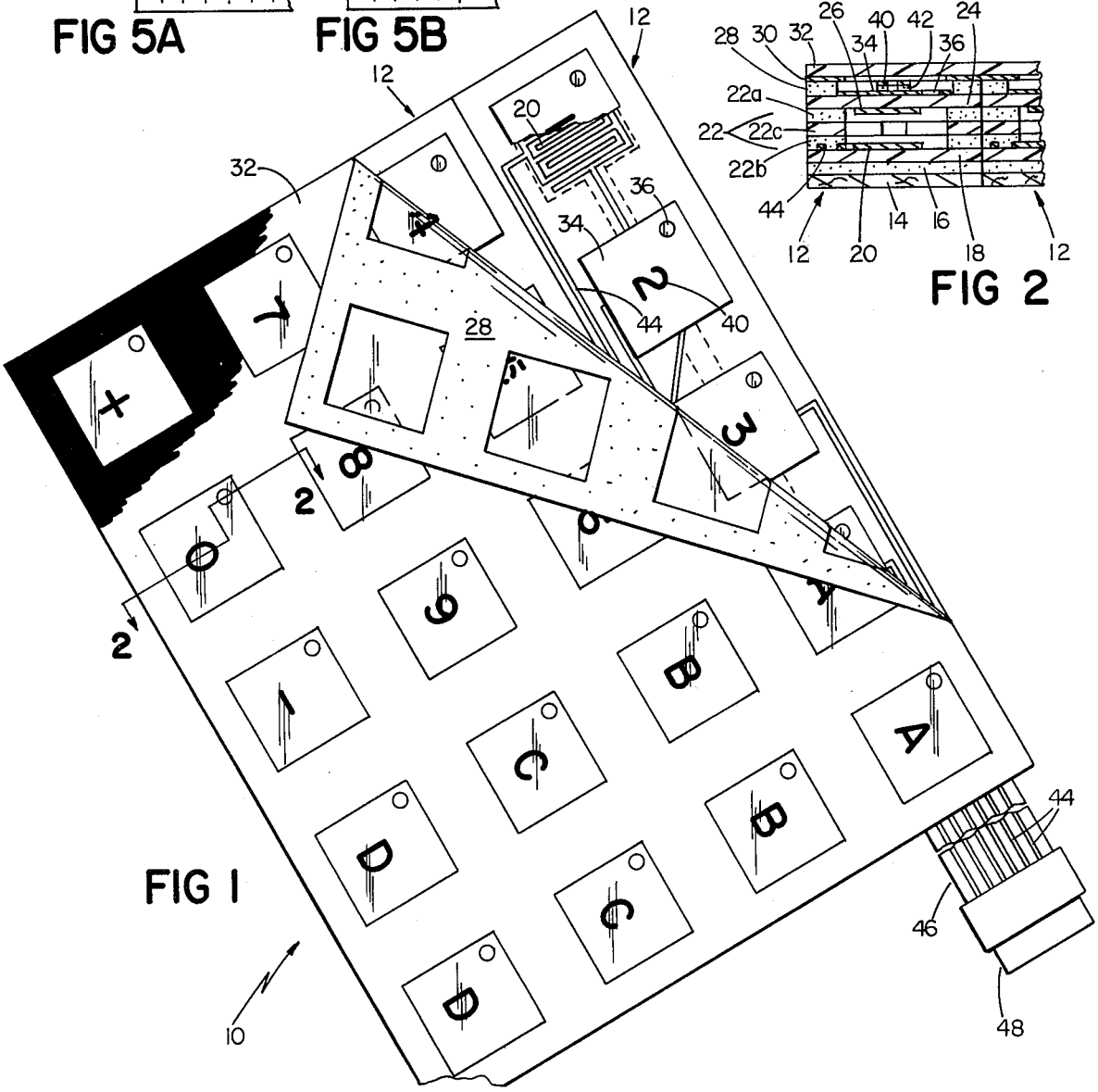
FIG 1

KIT FOR USE IN THE CONSTRUCTION OF CUSTOM PROTOTYPE MEMBRANE SWITCH PANELS

FIELD OF THE INVENTION

This invention relates to prototype kits for use in the construction of custom prototype membrane switch panels.

BACKGROUND OF THE INVENTION

The average cost of a custom prototype membrane switch panel is quite high, often more than many small companies can afford to spend.

SUMMARY OF THE INVENTION

I have discovered that an inexpensive prototype kit can be provided as a stock product, there being provided to cooperate with one another, a plurality of switch strips, an overlay sheet larger than individual strips for integrating and protecting said strips, said overlay sheet being adapted to overlie individual switch areas of said switch strips.

PREFERRED EMBODIMENT

I turn now to description of the drawings and the structure and operation of a preferred embodiment.

DRAWINGS

FIG. 1 is an isometric view, partially diagrammatic and partially broken away, of a custom prototype membrane switch panel made according to the invention.

FIG. 2 is a partial sectional view therethrough taken at 2—2 of FIG. 1.

FIG. 3 is a plan view, partially broken away, of the overlay sheet unit therefor.

FIGS. 4*a*–4*e* are plan views, partially diagrammatic, of switching strips therefor.

FIGS. 5*a* and 5*b* are partial plan views of number and letter transfer sheets.

STRUCTURE

There is shown in FIG. 1 a prototype membrane switch assembly indicated generally at 10.

As is shown in detail in FIG. 2, in the final assembly, switching strips 12 include release sheet 14, layer of adhesive 16, plastic lower contact sheet 18, bearing conductive ink switching portion 20, spacers 22 (made up of adhesive layers 22*a* and 22*b* and polyester layer 22*c*), upper plastic switching layer 24 bearing conductive ink contacts 26; thereabove are adhesive layer 28, opaque ink layers 30 and velvet polycarbonate overlay layer 32, the adhesive 28 and ink 30 being carried by said polycarbonate layer. Carried on the upper surface of layer 24 is a layer of white ink 34 having in it a transparent area 36.

OPERATION

To make a prototype membrane switch, there is of course first a decision of what type of assembly is desired. In the preferred embodiment illustrated there was desired a 20-switch assembly in a common bus configuration. Accordingly, 4 switching strips 12 are used, the overlay sheet 32 being of size to fit with 4 such strips. Release layer 38 (FIG. 3) is then removed, and the 4 switching strips 12 adhere to the lower surface of overlay layer 32 through adhesives 28. Prior to this step, in the embodiment shown, indicia squares 40 with adhesive 42 on their backs have been transferred from the transfer units shown in FIGS. 5*a* and 5*b* and adhered over the white ink 34 (which also forms a layer on which indicia may be written on by hand).

If fewer than 5 switch strips are needed, kit overlay sheet 50 (which can take all 5 switch strips in my preferred kit) may be easily and conveniently cut down to the desired size as is shown by the assembly in FIG. 1. Or, particular switch strips may be cut down, at their ends away from their tails, to provide less than five switches.

The transparent areas 36 provide backlighting windows for LED's (not shown).

Conductive printed ink patterns 44 on tail 46 of layer 24 terminate in connector 48 (the tail for only one strip 12 being shown in FIG. 1).

Five of the leads 44 come respectively from one side of each of the switches of the particular switch strip. The sixth of the leads 44 shown (shown centrally on the partially exposed switch strip, in FIG. 1, running between the switches numbered 1 and 2, then diagonally between the switches numbered 2 and 3, and thereafter running generally parallel to the other lead from the switch numbered 1) is the third from the bottom in the tail portion and is a common other lead to all five switches in the strip. It will be apparent to those skilled in the art that this configuration makes possible, through external wiring, using my prototype kit for an X-Y switch function. Other embodiments within the claims will occur.

What is claimed is:

1. A kit capable of being assembled into a prototype membrane switch comprising a plurality of switch units each said switch unit comprising at least one membrane switch, each said membrane switch including upper and lower plastic membranes, electrical contact portions adhered to said membranes, and a spacer element between said membranes, and an overlay sheet adapted to be affixed to the upper surfaces of each of said switch units, said overlay sheet having twice or more the area of each said switch unit and the shape of each said unit being selected so as to permit said plurality of units to be affixed in side-by-side relationship beneath said overlay sheet, and said overlay sheet being provided with indicia areas at locations selected to be coordinated with switch portions of said plurality of switch units upon assembly.

2. The kit of claim 1 in which each said switch unit includes a multiplicity of switches.

3. The kit of claim 2 in which each said switch unit includes a layer of adhesive and a release layer on its lower surface, and on its upper surface a layer on which may be written indicia.

4. The kit of claim 3 in which said overlay includes opaque portions defining transparent areas, said transparent areas being over said switch portions.

5. The kit of claim 4 which includes at least one indicia transfer unit.

* * * * *